United States Patent [19]

Hikuma et al.

[11] Patent Number: 4,787,230

[45] Date of Patent: Nov. 29, 1988

[54] ROLLING FLAT CUTTER AND METHOD OF ROLLING THEREBY

[75] Inventors: Hideo Hikuma; Masaji Yamada, both of Hamamatsu, Japan

[73] Assignee: Fuji Tekko Co., Ltd., Shizuoka, Japan

[21] Appl. No.: 24,157

[22] Filed: Mar. 10, 1987

[30] Foreign Application Priority Data

| | | | |
|---|---|---|---|
| Jun. 15, 1986 | [JP] | Japan | 61-138684 |
| Jun. 15, 1986 | [JP] | Japan | 61-138685 |
| Jun. 15, 1986 | [JP] | Japan | 61-90725[U] |
| Aug. 2, 1986 | [JP] | Japan | 61-119121[U] |

[51] Int. Cl.[4] ..... B21D 7/00; B21H 5/00

[52] U.S. Cl. ..... 72/88; 72/469; 72/95

[58] Field of Search ..... 72/469, 88, 90, 92, 72/95, 102–104, 108; 29/159.2

[56] References Cited

U.S. PATENT DOCUMENTS

| | | | |
|---|---|---|---|
| Re. 14,759 | 11/1919 | Wilcox | 72/469 |
| 352,365 | 11/1886 | Simonds . | |
| 1,907,684 | 5/1933 | Thomson . | |
| 3,015,243 | 1/1962 | Drader . | |
| 3,214,951 | 11/1965 | McCardell . | |
| 3,453,851 | 7/1969 | Morse | 72/469 |
| 3,872,699 | 3/1975 | Blue . | |
| 4,028,922 | 6/1977 | Killop . | |
| 4,646,549 | 3/1987 | Saito et al. | 72/95 |

FOREIGN PATENT DOCUMENTS

| | | | |
|---|---|---|---|
| 18746 | 9/1967 | Japan | 72/103 |
| 59-209448 | 11/1984 | Japan . | |
| 1075723 | 7/1967 | United Kingdom | 72/108 |
| 1470783 | 4/1977 | United Kingdom . | |

*Primary Examiner*—Daniel C. Crane

*Attorney, Agent, or Firm*—Wenderoth, Lind & Ponack

[57] ABSTRACT

A rolling flat cutter having finishing blades corresponding to corrugation of a product to be obtained by working a tubular or cylindrical workpiece, and a method of rolling by the flat cutter. When the workpiece is worked, a pair of flat cutters are disposed such that the finishing blades face each other, and the cutters are moved rectilinearly in opposite directions perpendicular to a direction in which the finishing blades extend so that the corrugation is formed on a periphery of the workpiece from an end to the other in an axial direction thereof. As to the rolling flat cutter, a flat cutter is used which comprises a rectangular cutter body, a triangular blade base formed as a higher step on one side of a plane of the cutter body along a straight line parallel with a diagonal of the plane, and the finishing blades are formed on the blade base.

8 Claims, 6 Drawing Sheets

ROLLING FLAT CUTTER AND METHOD OF ROLLING THEREBY

BACKGROUND OF THE INVENTION

The present invention relates to a rolling flat cutter, and more particularly to a flat cutter for rolling a workpiece which consists of a pipe or a solid shaft to press a spline, serration or the like to its periphery, and a method of rolling the workpiece by the flat cutter.

As a conventional flat cutter, there is a rolling flat cutter as shown in FIG. 1, for example.

The conventional flat cutter as shown comprises a rectangular solid body 2 which has a plurality of corrugated working blades 3 formed to extend in width on an upper surface of the body, the working blades 3 consisting of rough blades 4, medium blades 5 and finishing blades 6, which gradually increase in height from an initial portion to a terminal portion of the cutter body in a longitudinal direction.

At the time of working, as shown in FIG. 2, a pair of flat cutters 1 are disposed with the working blades 3 thereof facing each other, so that a tubular or cylindrical workpiece 7 is charged between them with the axis of the workpiece extending in a parallel direction to the blades 3. Then, both of the flat cutters 1 are moved rectilinearly with respect to each other in opposite directions so that the peripheral portion of the workpiece 7 can be rolled.

In such a conventional flat cutter 1, since the working blades 3 which are formed through a width w of the body 2 roll the portion of the workpiece 7, a load from the working blades 3 is high, and particularly if the workpiece 7 is a pipe member, the workpiece is deformed in an axial direction, and thus the precision of working is reduced. According to the prior art, for solving such a problem, a workpiece which consists of a solid shaft is used and rolled on a periphery thereof, and then the workpiece is cored by a drill.

However, there are problems in that it takes additional time to core the workpiece and the working thereof is complicated. In addition, in the conventional flat cutter 1, since the working blades 3 are formed horizontally throughout a width w of the body 2, the working blades 3 are worn out evenly in the direction of width of the body 2. Therefore, it is difficult to extend the life of a cutter by reabrading the worn portion of the working blades.

SUMMARY OF THE INVENTION

It is an object of the present invention to provide a rolling flat cutter and a method for rolling thereby which can solve the above-mentioned problems.

It is another object of the invention to provide a rolling flat cutter which can prevent a workpiece from being deformed by reducing the force applied to the workpiece at the time of working and which can perform the rolling in a precise manner.

It is another object of the invention to provide a rolling flat cutter which permits extension of its life by simply reabrading the worn portion of the working blades.

It is another object of the invention to provide a rolling flat cutter which can form a surface to be worked of a workpiece smoothly.

These and other objects, features and advantages of the invention will become apparent from the following description taken in connection with the accompanying drawings.

DESCRIPTION OF THE PREFERRED EMBODIMENTS

Figure 1:
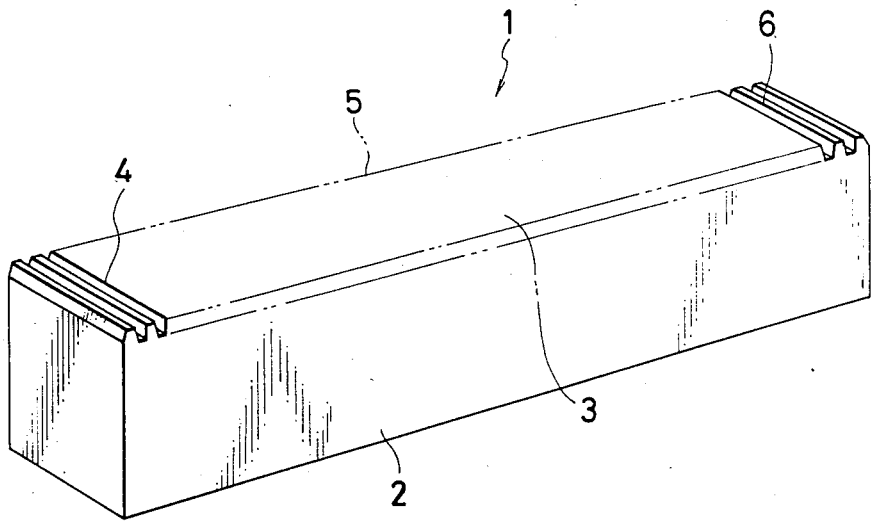
FIG. 1 PRIOR ART
FIG. 1 is a perspective view illustrating an example of a conventional rolling flat cutter.
Figure 2:
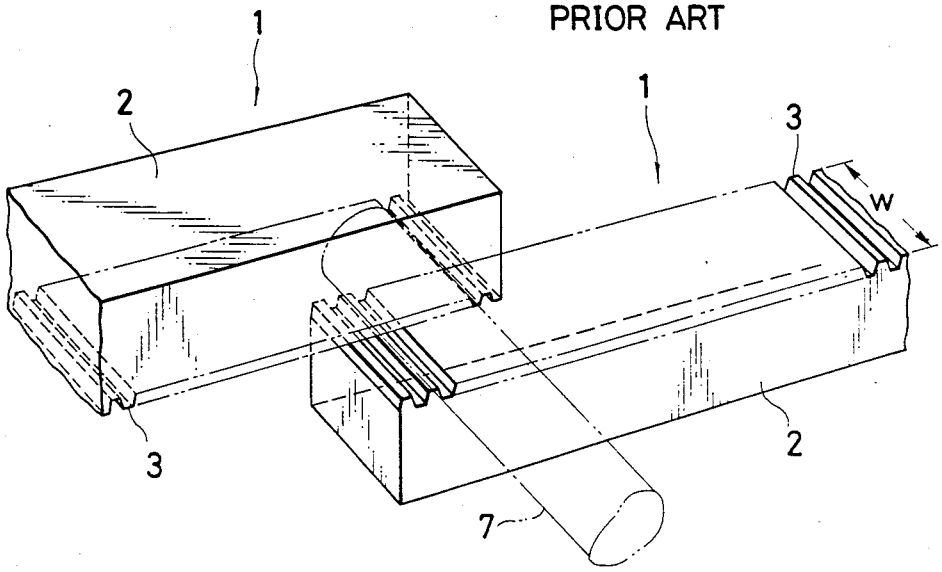
FIG. 2 PRIOR ART
FIG. 2 is a perspective view illustrating a method of rolling with the conventional rolling flat cutter.
Figure 3:
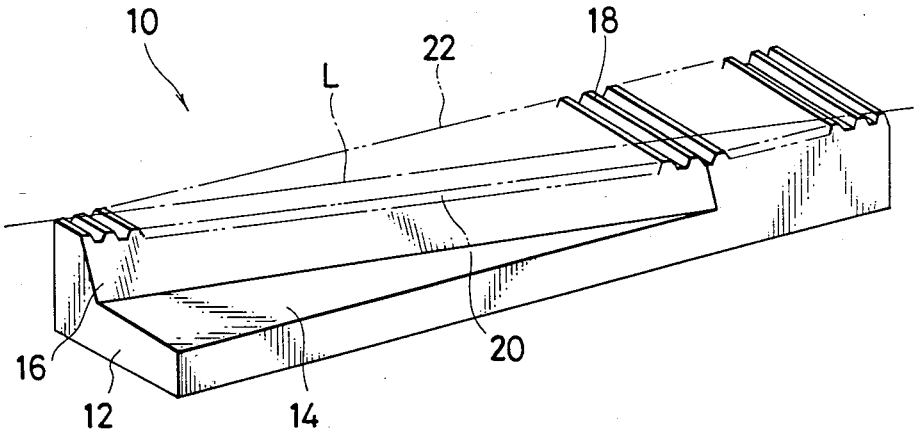
FIG. 3 is a perspective view illustrating a rolling flat cutter according to an embodiment of the present invention.
Figure 4:
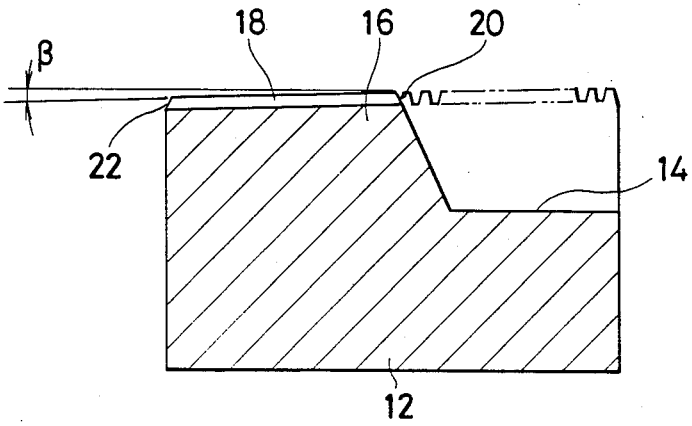
FIG. 4 is a sectional view of the flat cutter of FIG. 3.

Referring to FIGS. 3 and 4, there is shown one of a pair of flat cutters used on the upper and lower sides of a workpiece. The flat cutter 10 as shown comprises a rectangular solid body 12 which extends in a longitudinal direction and has an upper surface divided by a straight line parallel with a diagonal L of the rectangle into a triangular recessed portion 14 formed lower by a step on one side (lower side in the drawing) and a higher blade base portion 16 formed on the other side, the blade base 16 being narrowest at one longitudinal end of the cutter body and widest at the other longitudinal end of the cutter body with the one longitudinal end at which the narrowest part of the blade base is located comprising a leading end of the cutter body. A plurality of corrugated working blades 18 are formed on the base 16 with edges thereof extending in the widthwise direction. The working blades 18 consist of finishing blades having upper surfaces thereof which are inclined at an angle such that one end thereof is lower than a horizontal surface of the cutter body by a few degrees (transverse relief angle $\beta=1°$ to $2°$) from an end 20 of the blades facing the recessed portion 14 of the blade base 16 to another end 22 on the opposite longitudinal side of the cutter body.

Next, a method of rolling by the above mentioned flat cutter 10 will be explained with reference to FIGS. 5 and 6.

First, a pair of flat cutters 10 are disposed on the upper and lower sides of a workpiece with an initial point of the working blades 18, i.e. a blade portion 24 short in width, facing each other and a workpiece W is charged between both cutters, and then the cutters 10 are moved rectilinearly with respect to each other such that they are parallel with each other from the initial point to a terminal point in opposite directions.

Thus, first, the initial portion 24 short in width of the working blades 18 of the pair of flat cutters 10 (the narrowest part of the blade base comprising the leading end of the cutter body) presses to work an end of the workpiece W. Next, with the advance of the flat cutters 10 the end 20 of the working blades 18 facing the recessed portion 14 gradually moves in an axial direction of the workpiece W to work the peripheral portion of the workpiece progressively in the axial direction. At this time, since the working blades 18 of each cutter have the transverse relief angle $\beta$, the workpiece W is worked mainly by the end 20 of the respective working blades 18 facing the recessed portion 14.

Therefore, a force applied to the workpiece W by the working blades 18 is reduced to a lower level than a conventional one, with the result that deformation of the workpiece can be prevented.

In addition, since the end 20 of the working blades 18 facing the recessed portion 14 is parallel to the opposite end 22 at the terminal portion of the body 12, that is, the end 20 merges with an end 26 which extends longitudinally in a direction perpendicular to an axis of the workpiece W, an axially inside portion of the workpiece W can be worked equally in depth by the end 26.

Furthermore, the portions except the ends 20 and 26 of the working blades 18 make little contact with the workpiece W, resulting in little wear. Therefore, if the ends 20 and 26 of the cutting blades on the recessed portion side of the cutter body have been worn, then it is possible to reform new finishing blades by abrading the side of the blade base 16 on which the recessed portion 14 is located and the side of the body 12.

Figure 7:
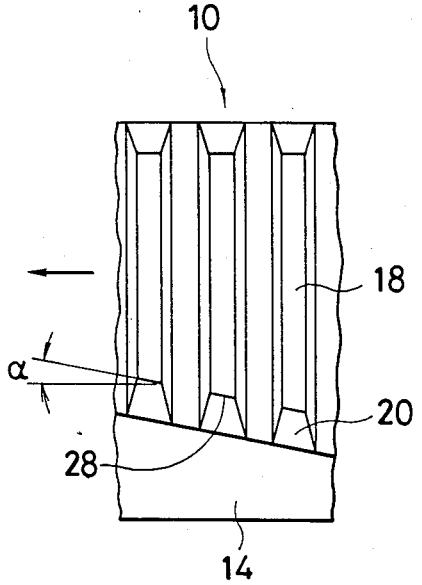
FIG. 7 is a plan view illustrating a portion of working blades of the rolling flat cutter of FIG. 3.

Next, in the above flat cutter 10, if the end 20 of the recess side of the working blades 18 had been chamfered parallel to the diagonal line L as shown in FIG. 7, edges 28 of the end 20 of the respective blades would have an inclined angle $\alpha$ with respect to the advance of the flat cutters 10. Therefore, it is anticipated that each of the edges 28 would cut to work the workpiece while it moves in an axial direction, resulting in damage on the worked surface, i.e. the side of the spline blades of the workpiece.

Figure 8:
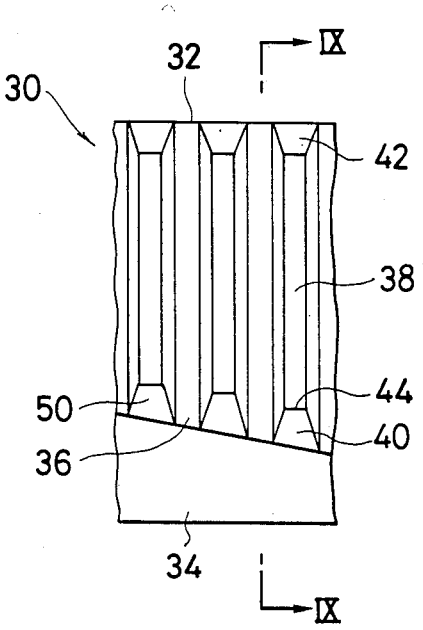
FIG. 8 is a plan view illustrating a portion of working blades of another embodiment.
Figure 9:
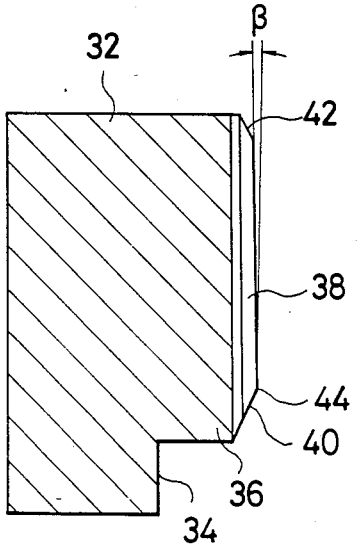
FIG. 9 is a sectional view taken on line IX—IX of FIG. 8.
Figure 10:
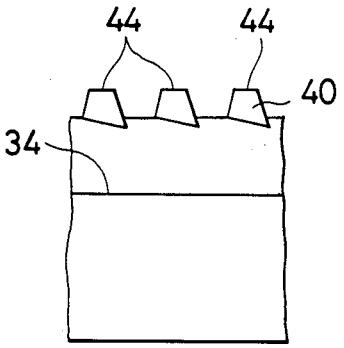
FIG. 10 is a view illustrating a portion of the working blades of FIG. 8.

FIGS. 8 to 10 illustrate a flat cutter which has solved this problem. The flat cutter 30 also comprises a rectangular solid body 32 as in the embodiment of FIGS. 3 and 4, which has an upper surface divided by a straight line parallel with a diagonal L of the rectangle into a triangular recess 34 formed lower by a step on one side and a higher blade base 36 formed on the other side, on which base 36 a plurality of corrugated working blades 38 are formed to extend in the widthwise direction. The working blades 38 consist of finishing blades having top surfaces which are inclined with respect to a horizontal surface by a few degrees (transverse relief angle $\beta = 1°$ to $2°$), the blades being lower in a direction from an end 40 on the recessed portion side of the blade base 36 to another end 42 on the opposite thereof. Thus, a plane containing the top surfaces of the blades forms a slight angle $\beta$ with respect to the central axis of the workpiece and the top surfaces of the blades at the recessed portion side of the blade base are closest to the central axis of the workpiece.

The end 40 of the working blades 38 facing the recessed portion 40 is chamfered such that an edge 44 is parallel to the long side of the body 32 and thus perpendicular to the central axis of the workpiece. The edge 44 can be formed by a method such as follows: For example, a disc like whetstone which has a width corresponding to the thickness of one working blade is available, and it is rotated with its rotation axis parallel to the long side of the body 32 centered so as to cut the end 40 of each working blade 38.

According to this embodiment, when a workpiece is worked, a pair of flat cutters 30 are disposed on the upper and lower sides of a workpiece with an initial point of the working blades 38, i.e. a portion short in width, facing each other and a workpiece W which consists of a pipe member is charged between both cutters, and then the cutters 30 are moved parallel with each other from the initial position to a terminal position in opposite directions.

Thus, at first the initial portion short in width of the working blades 38 of the pair of flat cutters 30 pressed to work an end of the workpiece W. Next, with the advance of the flat cutters 30 the end 40 of the respective blades 38 facing the recessed portion gradually moves in an axial direction along the workpiece W to work the peripheral portion of the workpiece W axially. At this time, since the working blades 38 of each flat cutter have the transverse relief angle $\beta$, the workpiece W is worked mainly by the end 40 of the respective working blades 38 facing the recessed portion 34.

In this embodiment, since the edge 44 of the end 40 of each working blade 18 facing the recessed portion 34 extends perpendicularly to the axis of the workpiece, each edge 44 can cut the workpiece without moving in the axial direction and form the surface of the workpiece smoothly.

Figure 11:
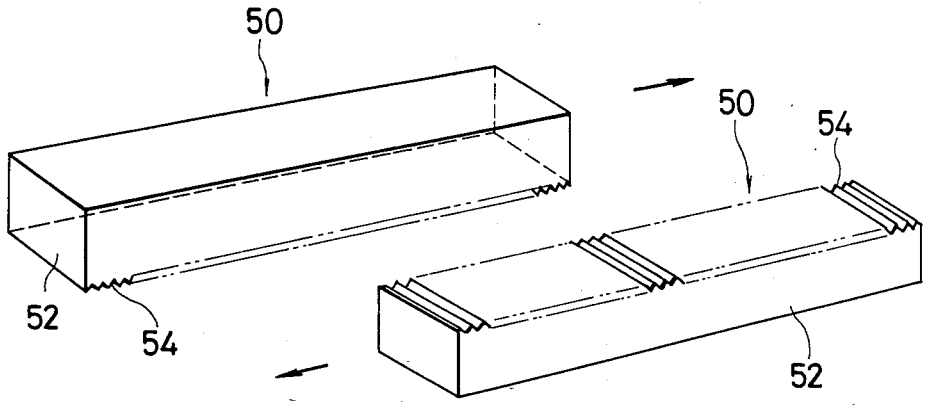
FIG. 11 is a perspective view illustrating still another embodiment.
Figure 12:
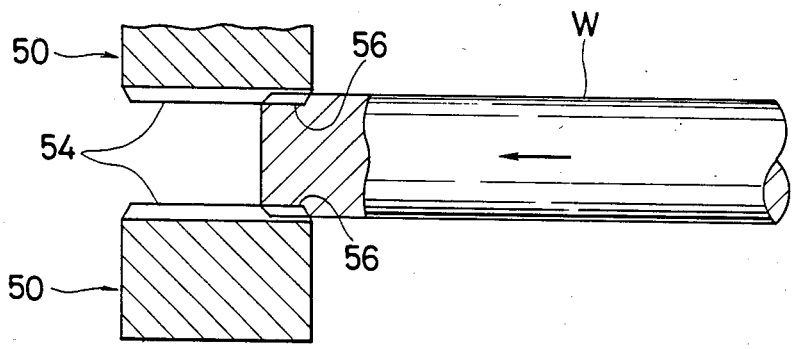
FIGS. 12 and 13 are partial sectional views illustrating a method of rolling by the rolling flat cutter of FIG. 11.
Figure 13:
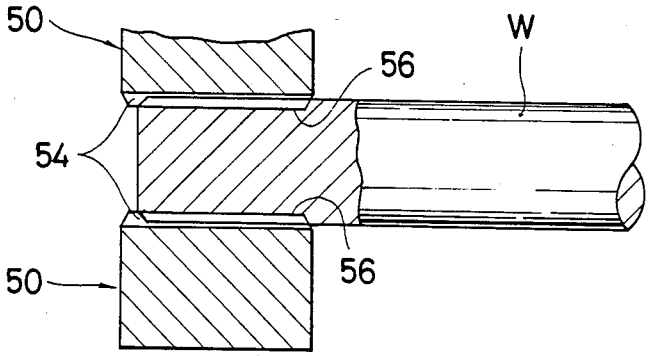

FIGS. 11 to 13 illustrate another embodiment of a rolling method of the invention.

A flat cutter 50 in this embodiment also comprises a rectangular solid body 52 as in the embodiment of FIGS. 3 to 6. However, the body 52 has an upper surface on all of which a plurality of corrugated working blades 54 are formed. The working blades 54 consist of finishing blades which are constant in height from an initial end to a terminal end thereof.

Figure 5:
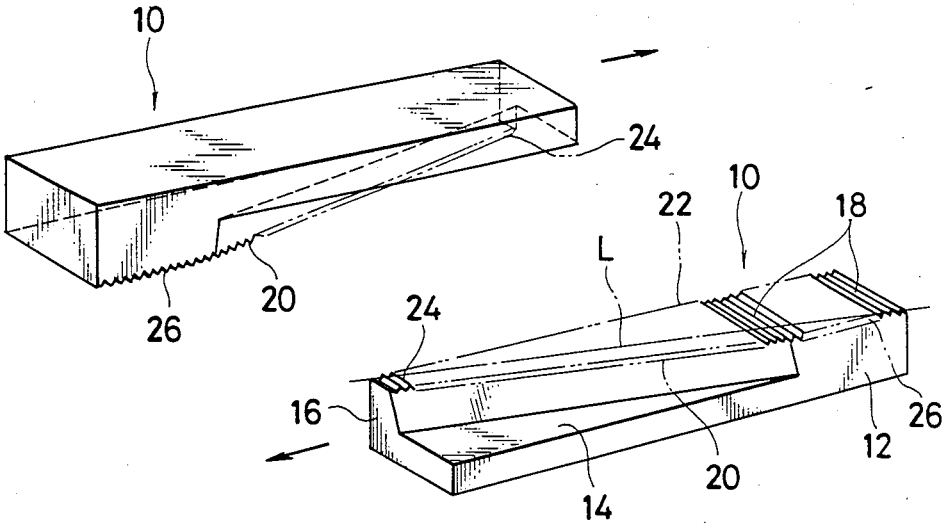
FIG. 5 is a perspective view illustrating a method of rolling by the flat cutter of FIG. 3.
Figure 6:
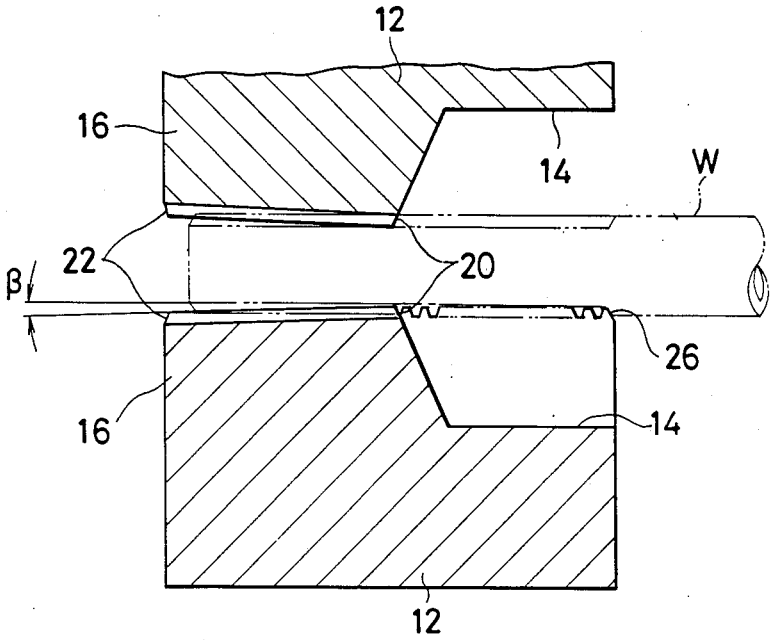
FIG. 6 is a sectional view taken through the parts shown in FIG. 5.

At the time of working, in addition to moving a pair of cutters 50 parallel with each other from the initial point to the terminal point in opposite directions as in the embodiment of FIGS. 5 and 6, a workpiece W is moved from the right side to the left side between the upper and lower working blades 54 as shown in FIGS. 12 and 13. Thus, with the advance of the flat cutters 50 a right end 56 of the respective progressively working blades 54 can work the peripheral surface of the workpiece W axially.

Figure 14:
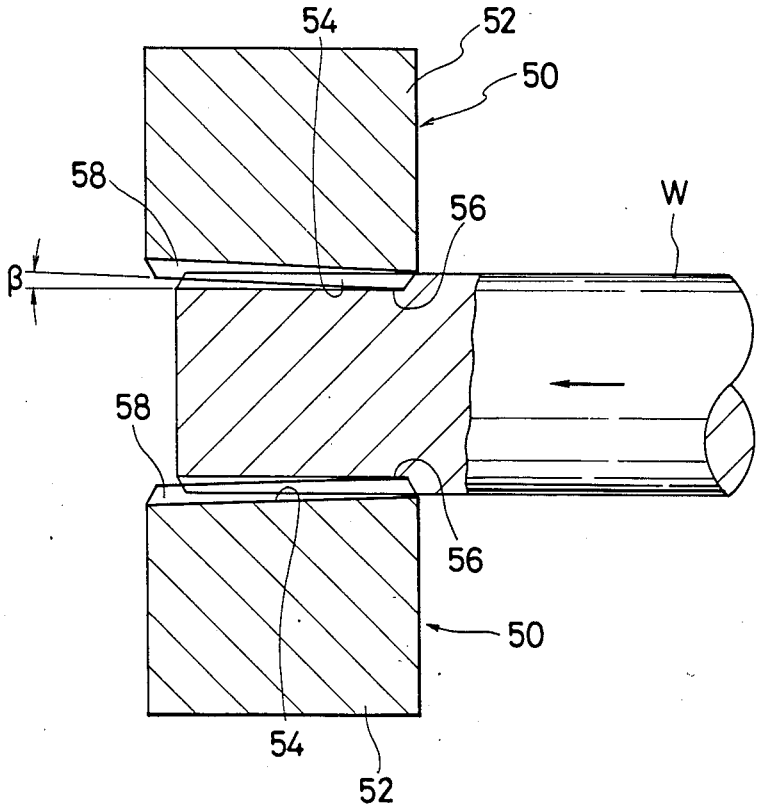
FIG. 14 is a partial sectional view illustrating a method of rolling by still another embodiment.

In this case, as shown in FIG. 14, if the top surfaces of the working blades 54 of the flat cutter 50 are formed to incline away from a horizontal surface or central axis of the workpiece at an angle of a few degrees (transverse relief angle $\beta = 1°$ to $2°$) from the right leading end 56 which first engages the workpiece to the left end 58, then the workpiece W is worked almost by the right end 56 of each working blade 54. Accordingly, a force applied to the workpiece W by the working blades 54 is reduced, hence it is possible to prevent the deformation of workpiece and the portions except the right end 56 of the working blades 54 make little contact with the workpiece W, resulting in little wear. Therefore, if the right end 56 of the working blades 54 has been worn, then it is possible to reform new finishing blades by abrading the right side of the body 52.

While preferred embodiments have been described, the present invention should not be limited thereto and modifications may be made within the scope of the appended claims.

What is claimed is:

1. A rolling flat cutter comprising a cutter body extending in a longitudinal direction and having an upper surface divided into a raised generally triangular blade base and a lower recessed portion, said blade base being narrowest at one longitudinal end of said cutter body and widest at the other longitudinal end of said cutter body, and a plurality of corrugated finishing blades formed on said blade base, said finishing blades extending in a direction perpendicular to said longitudinal direction, said one longitudinal end at which the narrowest part of said blade base is located comprising a leading end of said cutter body.

2. A rolling flat cutter according to claim 1, wherein said finishing blades have upper surfaces which lie in a plane which is inclined with respect to a central axis of a workpiece having a cylindrical periphery at a predetermined transverse relief angle such that an end of said finishing blades facing said recessed portion engages an outer periphery of the workpiece before an opposite end of said finishing blades engages the outer periphery of the workpiece.

3. A rolling flat cutter according to claim 1 or 2, wherein an edge of each of said finishing blades facing said recessed portion is parallel to said longitudinal direction, said rolling flat cutter being rectangular in shape, said triangular blade base formed as a higher step on one side of a plane of said cutter body along a straight line parallel with a diagonal of said plane.

4. In a method of working the surface of a workpiece having a cylindrical outer periphery by using a flat cutter, comprising the steps of placing the workpiece between a pair of flat cutters disposed such that a plurality of corrugated working blades of each cutter face each other, and moving said flat cutters rectilinearly with respect to each other in opposite directions perpendicular to a direction in which said working blades extend so that a peripheral portion of said workpiece can be rolled, said rolling flat cutters each comprising a rectangular cutter body extending in a longitudinal direction, said rolling flat cutter having a generally triangular blade base formed as a higher step with a lateral side thereof extending along a straight line parallel with a diagonal on one side of a plane of said cutter body whereby said blade base is narrowest at one longitudinal end of said cutter body and widest at the other longitudinal end of said cutter body, and said finishing blades being formed on said blade base and extending in a direction perpendicular to said longitudinal direction, said one longitudinal end at which the narrowest part of said blade base is located comprising a leading end of said cutter body, the improvement comprising:

forming all of said working blades as finishing blades corresponding to corrugation of a product to be obtained by working said workpiece; and moving said flat cutters rectilinearly in opposite directions perpendicular to said direction in which said finishing blades extend and progressively forming said corrugation on said peripheral portion of said workpiece by advancing said cutters along an axial direction of said workpiece.

5. A method of rolling according to claim 4, wherein said finishing blades are oriented such that upper surfaces thereof are inclined with respect to a central axis of the workpiece at a predetermined transverse relief angle such that one end of the finishing blades engages the workpiece prior to the other end of the finishing blades, and said one end of each finishing blade progressively forms said corrugation on said peripheral portion of said workpiece by advancing along an axial direction of said workpiece.

6. A method of rolling according to claim 4 or 5, wherein said flat cutters are rectangular solid cutters having said finishing blades formed on all of an upper surface of said triangular blade base, and said workpiece is moved between a pair of said rectangular solid cutters by moving said cutters rectilinearly in opposite directions and advancing said cutters axially along said workpiece.

7. A rolling flat cutter comprising:

a rectangular cutter body;

a substantially triangular body base portion formed as a higher step with a lateral side thereof extending along a straight line parallel with a diagonal on one side or a plane of said cutter body; and a plurality of corrugated finishing blades which are formed on the upper surface of said blade base portion and are extended in the direction perpendicular to the rolling direction of a workpiece upon rolling machining, wherein said finishing blades are formed in a manner such that each top surface thereof inclines at a predetermined transverse relief angle so that a height of each blade is higher than a horizontal surface from one end to the other end thereof on the side of said diagonal of said blade base portion and at the same time, an edge of each of said finishing blades at said other end on the side of said diagonal is formed in the direction perpendicular to the moving direction of said cutter body upon rolling machining.

8. A rolling machining method by a rolling flat cutter comprising a rectangular cutter body, a substantially triangular blade base portion formed as a higher step with a lateral side thereof extending along a straight line parallel with a diagonal on one side or a plane of said cutter body, and a plurality of corrugated finishing blades which are formed on the upper surface of said blade base portion and are extended in the direction perpendicular to the rolling direction of a workpiece having a cylindrical outer periphery upon rolling machining, wherein said finishing blades are formed in a manner such that each top surface thereof inclines at a predetermined transverse relief angle so that a height of each blade is higher than a horizontal surface from one end to the other end thereof on the side of said diagonal of said blade base portion and at the same time, an edge of each of said finishing blades at said other end on the side of said diagonal is formed in the direction perpendicular to the moving direction of said cutter body upon rolling machining, said method comprising the steps of:

arranging a pair of said rolling flat cutters so that the blade base portions face each other;

disposing the workpiece between said opposite blade base portions with the axis of the workpiece parallel to the direction in which said finishing blades extend;

rectilinearly moving said pair of rolling flat cutters in opposite directions; and thereby rolling machining splines on the cylindrical outer periphery of said workpiece.

* * * * *